US008491370B2

(12) United States Patent
Tarantino

(10) Patent No.: US 8,491,370 B2
(45) Date of Patent: Jul. 23, 2013

(54) WAGERING GAME HAVING OPPORTUNITY FOR PARTICULAR INCREASED AWARDS

(75) Inventor: Elia Rocco Tarantino, Las Vegas, NV (US)

(73) Assignee: AGS, LLC, Henderson, NV (US)

( * ) Notice: Subject to any disclaimer, the term of this patent is extended or adjusted under 35 U.S.C. 154(b) by 247 days.

(21) Appl. No.: 12/455,980

(22) Filed: Jun. 9, 2009

(65) Prior Publication Data

US 2010/0311499 A1 Dec. 9, 2010

(51) Int. Cl.
*A63F 9/24* (2006.01)

(52) U.S. Cl.
USPC ..... 463/13; 273/292

(58) Field of Classification Search
USPC ..... 273/292; 463/11, 13, 16, 12, 25
See application file for complete search history.

(56) References Cited

U.S. PATENT DOCUMENTS

| | | | | |
|---|---|---|---|---|
| 5,356,140 | A | 10/1994 | Dabrowski et al. | |
| 5,542,669 | A | 8/1996 | Charron et al. | |
| 6,149,521 | A | 11/2000 | Sanduski | |
| 6,179,711 | B1 | 1/2001 | Yoseloff | |
| 6,569,013 | B1 | 5/2003 | Taylor | |
| 6,605,002 | B2 | 8/2003 | Baerlocher | |
| 6,669,198 | B2 | 12/2003 | Wichinsky | |
| 6,698,758 | B2 | 3/2004 | Hodge | |
| 7,022,016 | B2 | 4/2006 | Wood et al. | |
| 7,059,965 | B2 | 6/2006 | Jackson | |
| 7,156,397 | B2 | 1/2007 | Moody et al. | |
| 7,247,092 | B2 | 7/2007 | Jarvis et al. | |
| 7,316,608 | B2 | 1/2008 | Moody | |
| 2002/0160827 | A1 | 10/2002 | Slomiany et al. | |
| 2003/0134673 | A1* | 7/2003 | Moody | 463/20 |
| 2003/0207713 | A1* | 11/2003 | Taylor | 463/25 |
| 2004/0002376 | A1 | 1/2004 | Swift et al. | |
| 2004/0017043 | A1 | 1/2004 | Moody | |
| 2004/0116171 | A1* | 6/2004 | Moody | 463/13 |
| 2004/0198481 | A1* | 10/2004 | Herrington et al. | 463/13 |
| 2005/0110215 | A1* | 5/2005 | Jackson | 273/292 |
| 2006/0084500 | A1 | 4/2006 | Baerlocher et al. | |
| 2006/0135239 | A1 | 6/2006 | David | |
| 2006/0148557 | A1 | 7/2006 | Okada | |

(Continued)

OTHER PUBLICATIONS

The Wizard of Odds, Jacks or Better, Sep. 28, 2008, http://wizardofodds.com/jacksorbetter.*

(Continued)

*Primary Examiner* — Dmitry Suhol
*Assistant Examiner* — Jason Yen
(74) *Attorney, Agent, or Firm* — Weide & Miller, Ltd.

(57) ABSTRACT

An opportunity for higher awards for particular winning outcomes in a wagering game enhances the entertainment and enticement provided by a wagering game. In one embodiment, the opportunity is provided when the player has an initial set of indicia which contains a winning outcome. The opportunity allows a player to forgo this initial winning outcome for the chance to obtain increased awards for other winning outcomes. In this manner, the opportunity enhances a wagering game by allowing players a choice to take the award for the initial winning outcome or to risk this award in return for the chance to win increased awards for other winning outcomes. The increased awards for each winning outcome may be slight or substantial depending on the odds of the winning outcome occurring from the player's initial set of indicia.

14 Claims, 7 Drawing Sheets

U.S. PATENT DOCUMENTS

| | | | | |
|---|---|---|---|---|
| 2006/0178183 | A1 | 8/2006 | Van Asdale | |
| 2006/0258425 | A1* | 11/2006 | Edidin et al. | 463/16 |
| 2006/0270477 | A1* | 11/2006 | Snow | 463/11 |
| 2007/0026920 | A1* | 2/2007 | Flint et al. | 463/13 |
| 2007/0135193 | A1 | 6/2007 | Nicely | |
| 2007/0218982 | A1 | 9/2007 | Baerlocher | |
| 2007/0265051 | A1* | 11/2007 | Tarantino | 463/16 |
| 2007/0298855 | A1* | 12/2007 | Woodbury et al. | 463/13 |
| 2008/0153560 | A1* | 6/2008 | Moody | 463/13 |
| 2009/0170582 | A1* | 7/2009 | Hall | 463/12 |

OTHER PUBLICATIONS

Terry Murphy, "Midwest Casino Guide—VP Does VP in Windsor", http://www.midwestcasinoguide.com/show_article.php?article_id=17&author_id=3, © 2007,2003,2002, Midwest Casino Guide, 6 pages.

"IGT Back It Up™ Poker", http://www.igt5.com/GamingGroup/Games/game_detail.asp?toggle=ovr&pid=5&type_id=3349&pl=, © 2002-2007 IGT, 2 pages.

* cited by examiner

*Fig. 4*

| WINNING OUTCOMES | 1 CREDIT |
|---|---|
| Royal Flush | 100 |
| Straight Flush | 30 |
| Four of a Kind | 15 |
| Full House | 11 |
| Flush | 9 |
| Straight | 7 |
| Three of a Kind | 5 |
| Two Pair | 3 |
| Jacks or Better | 1 |

404

104

WAGERING GAME HAVING OPPORTUNITY FOR PARTICULAR INCREASED AWARDS

FIELD OF THE INVENTION

The present invention relates to wagering games, and specifically to a wagering game having an opportunity for particular increased awards based on an initial set of indicia.

BACKGROUND OF THE INVENTION

Traditional games such as the very popular draw video poker provide a winning player with an award associated with a winning outcome of a game. Winning outcomes are generally defined by a paytable of winning hands and associated rewards. This paytable is static, in that the player knows before the game begins the particular winning outcomes and their awards. Thus, when a player receives their initial set of cards dealt to them, the player simply evaluates those cards against the paytable to try and form the best hand. The player decides which cards to hold and which cards to discard and replace. Once the player's hand has been formed it is evaluated to determine if the player has a winning outcome. The player is paid the award if the player has a winning outcome. The player may then play a new game or take the award and discontinue play.

In an effort to add excitement and player enticement to such traditional games, various bonuses, jackpots, or side games have been added to these games. For example, some games may offer a paytable which includes a jackpot for a particular hand. While these features can add some excitement to winning outcomes of the game, they do not make the underlying game more exciting.

SUMMARY OF THE INVENTION

An opportunity for increased awards in a wagering game based on a player's initial set of indicia is provided herein. The opportunity may be implemented in various types of games including electronic games and table games and in wagering and non-wagering games. In one or more embodiments, the opportunity increases the excitement and enticement of a wagering game by allowing a player to forgo a winning set of indicia for the chance to win one or more increased awards. The increased awards may be substantial in some cases to entice a player to forgo his or her winning set of indicia for the chance to win the increased award.

In one embodiment, a paytable for providing an opportunity for increased awards in a wagering game is provided. The paytable may comprise one or more winning outcomes having one or more awards associated therewith, a display for presenting the one or more winning outcomes and the one or more awards to a player, a memory device for storage and retrieval of the one or more winning outcome and the one or more awards, and a processor in communication with the display and the memory device. The processor may be configured to determine if an initial set of indicia is a winning outcome and if so to generate one or more increased awards for each of the one or more winning outcomes that require the player to forgo the winning outcome whereby the one or more increased awards are presented to the player on the display. For example, in poker embodiments, the processor may generate the one or more increased awards for achieving a Straight, Flush, Straight Flush, and Royal Flush when the initial set of indicia contains a Pair of Jacks or Better.

It is noted that the processor may be configured to generate the one or more increased awards for each of the one or more winning outcomes that requires the player to forgo the winning outcome and that is a higher rank than the winning outcome in some embodiments. Also, the one or more winning outcomes may be ranked based on the one or more awards associated therewith.

In one embodiment, a gaming machine for presenting an opportunity for increased awards in a game is provided. The gaming machine may comprise a paytable comprising one or more winning outcomes having one or more awards associated therewith where the one or more winning outcomes are ranked based on the one or more awards associated therewith. The gaming machine may also comprise a display configured to present the paytable to a player, a memory device for storing the paytable, and a processor in communication with the display and the memory device.

The processor may be configured to determine if an initial set of indicia contains an initial winning outcome based on the paytable. The processor may then award an increased award to the player for a winning outcome achieved after forgoing the initial winning outcome, and award one of the one or more awards to the player for a winning outcome achieved without forgoing the initial winning outcome. Also, the processor may be configured to award the increased award to the player for the winning outcome achieved after forgoing the initial winning outcome only if the winning outcome is a higher rank than the initial winning outcome. Further, the processor may be configured to award the increased award to the player for the winning outcome achieved without forgoing the initial winning outcome if the winning outcome has a low likelihood of occurring from the initial set of indicia. It is noted that the increased award may be increased an amount based on the odds of the winning outcome occurring from the initial set of indicia in one or more embodiments.

A method of providing an opportunity for increased awards is provided herein as well. The game may be presented and played with one or more physical playing cards. Of course, the method may be implemented electronically as well.

In one embodiment, the method comprises accepting a wager from a player, providing a first paytable comprising one or more winning outcomes having one or more awards associated therewith, dealing an initial set of indicia to the player, evaluating the initial set of indicia to determine if the initial set of indicia is an initial winning outcome by comparing the initial set of indicia to the one or more winning outcomes, and associating one or more increased awards with one or more of the one or more winning outcomes that require the player to forgo the initial winning outcome. In one embodiment, determining the amount of the one or more increased awards may be based on the odds of the one or more winning outcomes occurring from the initial set of indicia.

It is noted that the one or more increased awards may be associated with one or more of the one or more winning outcomes that are unlikely to occur from the initial set of indicia in some embodiments. Also, the one or more increased awards may be associated with one or more of the one or more winning outcomes that require the player to forgo the initial winning outcome only for the one or more winning outcomes that outrank the initial winning outcome in some embodiments.

A second paytable comprising the one or more winning outcomes having the one or more increased awards associated therewith may then be generated. For example, the second paytable may be generated by including the one or more increased awards on the first paytable. After it is generated, the second paytable may be presented to a player. The initial set of indicia may then be manipulated according to one or more rules of a wagering game, and the player may subsequently be paid according to the second paytable. It is noted that the first paytable may be presented to a player as well.

Further objects, features, and advantages of the present invention over the prior art will become apparent from the detailed description of the drawings which follows, when considered with the attached figures.

DESCRIPTION OF THE DRAWINGS

The components in the figures are not necessarily to scale, emphasis instead being placed upon illustrating the principles of the invention. In the figures, like reference numerals designate corresponding parts throughout the different views.

FIG. 4 is an exemplary paytable for a poker type game;

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention is a method of presenting and playing a wagering game having an opportunity for increased awards based on an initial set of indicia. Though described with regard to particular wagering games herein, it is contemplated that the opportunity may be associated with a non-wagering game. Another aspect of the invention comprises table game apparatus, gaming machines and gaming systems for implementing the method. For example, the game may be presented electronically via a gaming machine or non-electronically with one or more physical playing cards, dice, or the like. In general, the game is advantageous in that it increases excitement and enticement provided by a game. For example, in one embodiment of a game of the invention, a player may have to forgo (i.e. give up) an initial winning hand to try and achieve a different winning hand having an increased award. In this manner, additional strategy, excitement, and game play are added to a game.

As will be described further below, the opportunity typically includes one or more higher or increased awards associated with one or more particular winning outcomes of a wagering game. Upon achieving one of these outcomes, the player is paid the increased award. In one embodiment, the increased award amount and/or the outcomes to be associated with the increased award is determined by evaluating the initial hand or initial set of indicia provided to a player. In a preferred embodiment, increased awards for particular winning outcomes are determined based on the likelihood of their occurrence from an initial set of indicia, such as an initial set of cards deal to a player.

Figure 1:
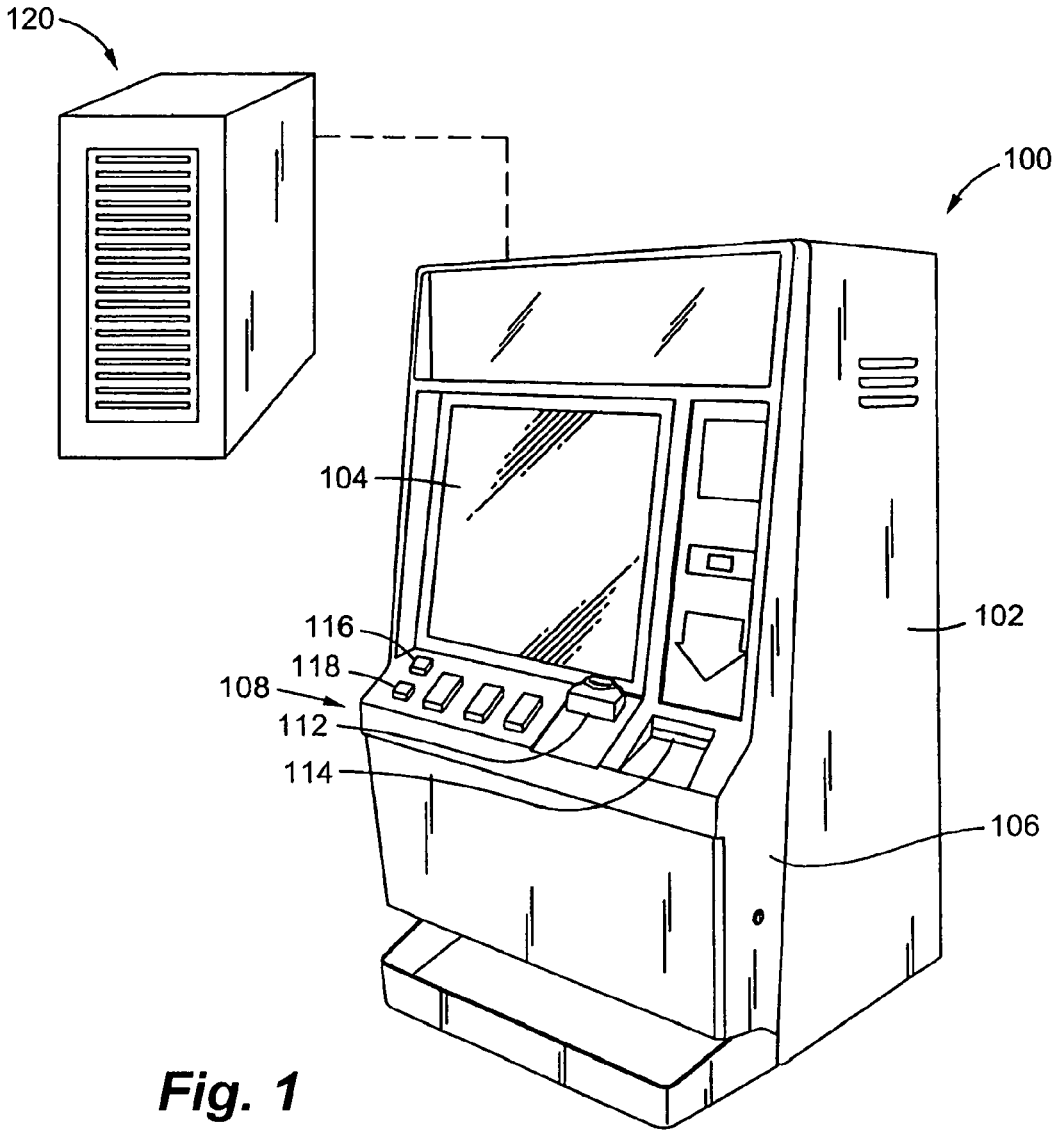
FIG. 1 is a perspective view of an exemplary gaming machine and server.

FIG. 1 illustrates one embodiment of a gaming machine 100 at which a wagering game having the opportunity herein may be implemented. In one embodiment, the gaming machine 100 is a wager-based gaming machine configured to present one or more games to a player, which games offer the possibility of an award of winnings. Of course, the gaming machine 100 could be configured to present games or amusing activities based upon payment and either not award winnings or offer the opportunity for points, tickets, prizes or the like.

In one embodiment, the gaming machine 100 defines a generally enclosed interior space for housing one or more components. As illustrated, the gaming machine 100 generally comprises a housing or cabinet 102 for supporting and/or enclosing various components required for operation of the gaming machine. In the embodiment illustrated, the housing 102 may include a door 106 located at a front thereof, the door capable of being moved between an open position which allows access to the interior and a closed position in which access to the interior is generally prevented. The configuration of the gaming machine 100 may vary. In the embodiment illustrated, the gaming machine 100 has an "upright" configuration. However, the gaming machine 100 could have other configurations, shapes or dimensions (such as being of a "slant"-type or other configuration as is well known to those of skill in the art). It is noted that the configuration of the door 106 may vary, such as dependent upon the configuration of the gaming machine 100.

The gaming machine 100 preferably includes at least one display device 104 configured to display game information. The display device 104 may be a mechanical, electro-mechanical or electronic display, such as one or more rotating reels, a video display or the like. When the display device 104 is an electronic video display, it may comprise a cathode ray tube (CRT), high resolution flat panel liquid crystal display (LCD), projection LCD, plasma display, field emission display, digital micro-mirror display (DMD), digital light processing display (DLP), LCD touchscreen, a light emitting display (LED) or other suitable displays now known or later developed, in a variety of resolutions, sizes and formats (e.g. 4:3, widescreen or the like). The display 104 may be capable of projecting or displaying a wide variety of information, including images, symbols and other indicia or information associated with game play, game promotion or other events. In one embodiment, the display 104 may be used to present one or more paytables associated with the opportunity for increased awards. It is contemplated that more than one display 104 may be provided in a gaming machine. Each display 104 may present different information. For example, a display 104 may be used to present one or more paytables while another display is used to present a game.

The gaming machine 100 may be configured to present various styles or configurations of games having the inventive features described herein. These may include games in Class III, such as video poker games, slot-type games, and blackjack or other card, dice or various other games now known or later developed, as well as games in Class II, including central determinant games such a video lottery, bingo and bingo-based games, and other games now known or later developed. The games may also be skill based or include one or more skill components. In one embodiment, certain game outcomes may be designated as winning outcomes. Awards may be provided for winning outcomes, such as monetary payments (or representations thereof, such as award of credits), prizes or the like. As is well known in the art, the number of winning outcomes may vary dependent upon the desired payout or winning percentage offered to the players as compared to wagers that are retained by the gaming establishment.

The gaming machine 100 may include one or more player input devices 108 (such as input buttons, a touch-screen display, joystick, touch-pad or the like) that may be utilized by the player to facilitate game play. The gaming machine 100 may include a coin accepting mechanism 112 for accepting coins and/or a currency or bill acceptor 114 for accepting cash or paper currency. It is also contemplated that other mechanisms may be provided for accepting value for game play, such as credit card, ticket readers or input devices whereby a player may have funds paid from a remote account. The gaming machine 100 may also include a "bet credit" button 118 or the like, such as to permit a player to wager monetary credits credited to the machine.

In one preferred embodiment, the gaming machine 100 includes one or more microprocessors or controllers for controlling the gaming machine, including receiving player input and sending output signals for controlling the various components of the machine 100 (such as generating game information for display by the display 104). The controller may be arranged to send signals for determining winning combinations and to cause the display 104 to display winning amount information. In addition, the controller is preferably arranged to determine if a round of game play has resulted in a win, and if so, the amount to be paid to the player for that win.

The gaming machine 100 may include a means for paying a player any winnings accumulated during game play. For example, a "cash out" button 116 may be provided for permitting a player to be paid the winnings or redeeming any credits initially paid into the gaming machine 100. The term "cash out" is used herein to define an event initiated by the player wherein the player receives a number of coins or currency that is equivalent to the value of the player's accrued credit base. Typically when a player cashes out, the player receives either a paper currency voucher or currency in the form of a coin disbursement. If the player decides to receive a coin disbursement, the gaming machine 100 may activate a coin hopper or coin handling device (not shown) which physically counts and delivers the proper number of coins to the player. The coin handling device is commonly configured to transport coins from a supply source (hopper or bin filled with coins) to a coin tray or payout receptacle where the player physically receives the coins. The player might also elect to cash out by having a ticket or other media dispensed, such as via a printer.

The gaming machine 100 may be configured as a standalone device or be in communication with one or more external devices at one or more times. For example, the gaming machine 100 may be configured as a server based device and obtain game code or game outcome information from a remote server. The gaming machine 100 may also communicate with one or more gaming servers 120. These one or more gaming servers 120 may be configured to perform accounting, player tracking, bonusing, game generation, or other functions.

In one embodiment, a gaming machine 100 may include various hardware and/or software for implementing the opportunity for increased awards. For example, one or more player input devices 108 may be provided for implementing the opportunity. In one embodiment, an "accept" player input device 108 may be provided to allow a player to accept the opportunity for increased awards. Once the opportunity is accepted, the player may be presented an updated or new paytable including one or more increased awards. It is contemplated that a "decline" player input device 108 may also be provided to allow the player to decline the opportunity. The player input devices 108 may be physical buttons or touch buttons on a display 104 in one or more embodiments.

Figure 2:
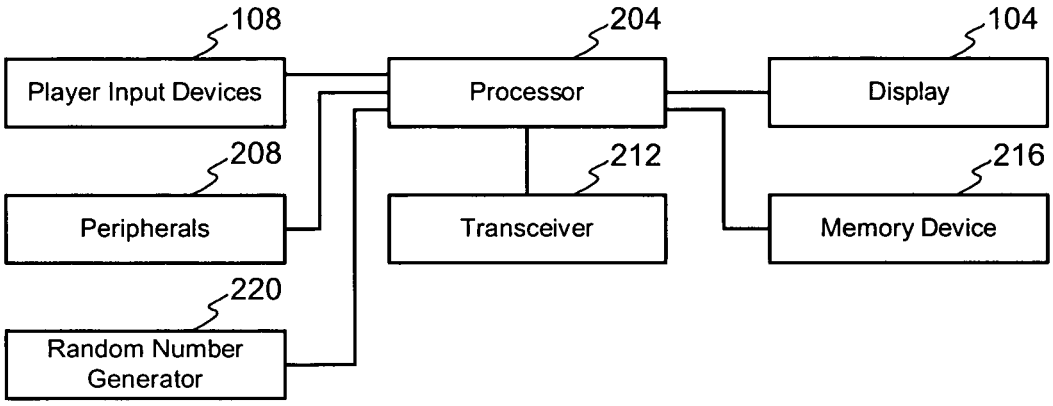
FIG. 2 is a block diagram of the components of an exemplary gaming machine.

FIG. 2 illustrates the components of an exemplary gaming machine. As shown, the gaming machine comprises a processor 204, display 104, a memory device 216, one or more player input devices 108, and a random number generator 220. A gamine machine may also comprise one or more peripherals 208 to facilitate play of a game such as card readers, coin acceptors, bill acceptors, coin hoppers, ticket/receipt printers or dispensers, and the like, as detailed above.

The gaming machine may also include a transceiver 212 to allow the gaming machine to communicate with external devices such as other gaming machines, game controllers, progressive controllers, gaming servers, and the like. The transceiver 212 may allow wired or wireless communications via one or more network or other connections. It will be understood that the game freeze feature may be implemented in various embodiments of gaming machines that may include additional or other electronic components, or that may not require one or more of the components illustrated in FIG. 2.

As indicated, the gaming machine may include a random number generator 220 for use in generating random game results or outcomes. It is noted that the random number generator 220 may be a separate component or part of another component, such as the processor 204, in one or more embodiments. The random number generator 220 may be configured to provide one or more random numbers to facilitate the play of one or more games. As is known, random numbers are commonly used in wagering games to provide an outcome of a game.

The random number generator 220 may accept one or more seed values in one or more embodiments from which one or more random numbers may be generated. The seed value may represent various tangible objects or characteristics. For example, a measurement of vibration, temperature, voltage, or time may be used as a seed value. It is noted that the random number generator 220 may include or be connected to one or more sensors or the like to measure these or other values for use as seed values. It is also noted that in server based gaming environments, the random number generator 220 may be remote from one or more gaming machines and that the random numbers generated by the random number generator may be communicated to the gaming machines and/or game outcomes may be provided to the gaming machine.

In general, the processor 204 may be a microprocessor, circuit, controller, or the like configured to process input and generate output to present one or more games, provide the opportunity for higher awards, or both. In one or more embodiments, the processor 204 may execute machine readable code to present one or more games, provide the opportunity for increased awards, or both. In one or more embodiments, the machine readable code comprises instructions that the processor 204 may execute to provide the opportunity for increased awards as described herein. The output from the processor 204 may be used to control or communicate with other components connected to the processor such as a display 104, transceiver 212, or gaming machine peripherals 208. A processor 204 may accept input from one or more player input devices 108 or other components connected to the processor.

In one or more embodiments, the processor 204 may be connected to a memory device 216 configured to store data. The memory device 216 may be various types of electronic memory, now known or later developed, including but not limited to magnetic, flash, or optical memory.

The memory device 216 may be configured to store machine readable code for one or more games. The memory device 216 may alternatively or additionally store machine readable code for the opportunity for increased awards. In this manner, the processor 204 may retrieve and execute machine readable code to present one or more games or the opportunity for increased awards to players. It is noted that a processor 204 may include its own memory in some embodiments. In addition, the machine readable code may be hardwired into the circuitry of a processor 204. In these embodiments, a separate memory device 216 may not be required.

It is contemplated that a memory device 216 may also be configured to store information for one or more games, the opportunity for increased awards, or both. For example, information related to the play or execution of a game and the opportunity for particular higher awards such as but not limited to credits, amounts wagered, amounts won, one or more paytables, winning outcomes, award amounts, paylines, jackpot amounts, bonuses, and randomly generated numbers may be stored in the memory device 216.

As will be described further below, a player may engage a player input device 108 to play a game and/or accept or decline an opportunity for higher awards. Engaging the appropriate player input device 108 may send a signal or information to the processor 204 indicating the player desires to accept or decline an opportunity. The processor 204 may then execute one or more functions to provide the opportunity as described herein.

Figure 3:
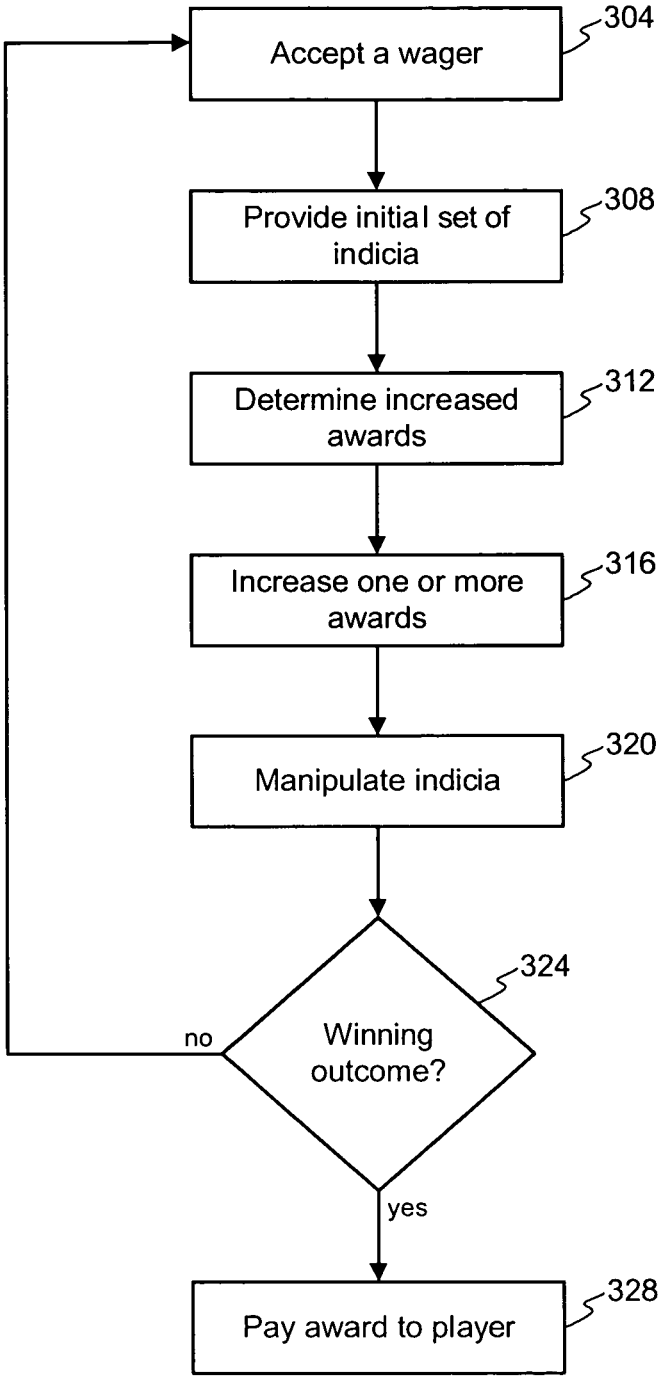
FIG. 3 is a flow diagram illustrating the opportunity for higher awards according to an embodiment of the invention.

A wagering game and higher award opportunity will now be described with regard to FIG. 3. FIG. 3 is a flow diagram illustrating an exemplary wagering game which provides the higher award opportunity to a player. Though described herein with regard to particular games, it will be understood that the opportunity may be provided with other games now known or later developed.

In one or more embodiments, the game will provide a paytable which defines one or more outcomes of the game as winning outcomes. For example, a small number of the potential outcomes of the game may be designated as winning outcomes. The paytable may also associate or indicate one or more award amounts with each of the winning outcomes. As indicated above, in one embodiment, these awards might comprise monetary credits, monies, points or other awards. An exemplary paytable 404 is illustrated in FIG. 4 for a poker type game. The paytable 404 of FIG. 4 illustrates the paytable of winning outcomes and associated awards for a particular wager. It will be understood that multiple awards may be associated with a single winning outcome, such as where a wagering game allows wagers of various amounts to be placed. The winning outcomes may be ranked in one or more embodiments. For example, winning outcomes may be ranked from highest to lowest based on their probability or odds of occurring, their award amounts, or both. Though shown presented by a display 104 of a gaming machine, it is contemplated that the paytable 404 may be presented through various mediums including those that are not electronic.

In a preferred embodiment, the game is presented as a wagering game and thus, at a step 304, a wager is accepted from a player. This may occur in various ways. For example, a wager may be accepted through electronic credits, a coin or bill acceptor, by a dealer or other gaming establishment personnel, or the like. It is contemplated that wager acceptance may occur in any way now know or later developed for accepting credits, currency, tokens, or other items of value. As indicated above, it is possible for the game to be presented as an amusement game or the like where no wager is required.

After the wager has been accepted, an initial set of indicia is generated or provided. For example, the indicia may be displayed or dealt to a player at a step 308. The indicia may be various symbols, characters, graphics, or the like. A combination of symbols, characters, graphics, or the like may also be used. In one embodiment, the indicia comprise playing card symbols. For example, in a poker embodiment, the initial set of indicia may be five playing cards. It will be understood that other indicia other than cards may be used as appropriate to the wagering game having the opportunity. For example, an initial set of indicia may comprise slot symbols such as the variety of graphic elements found on the reels of a slot machine.

At a step 312, the initial set of indicia may be evaluated to determine which winning outcomes will have their associated award increased from the base or initial award indicated in the paytable, the amount that an award will be increased, or both. This determination may occur in a variety of ways. In one or more embodiments, the determination may be made to entice players to risk a winning initial set of indicia to obtain an increased award. In addition or alternatively, the determination may be made to entice players to place their wager at risk to obtain an increased award. In this manner, a player may put his or her wager or winning initial set of indicia at risk for the reward of a potential increased award. As will be described below, the increase to an award may range from slight to substantial to entice players to take the opportunity for an increased award. Typically, one or some, but not all of the winning outcomes will have their awards increased. It is also possible that in some games one or more winning outcomes will have their awards increased, while in other games, no changes will be made.

Figure 5:
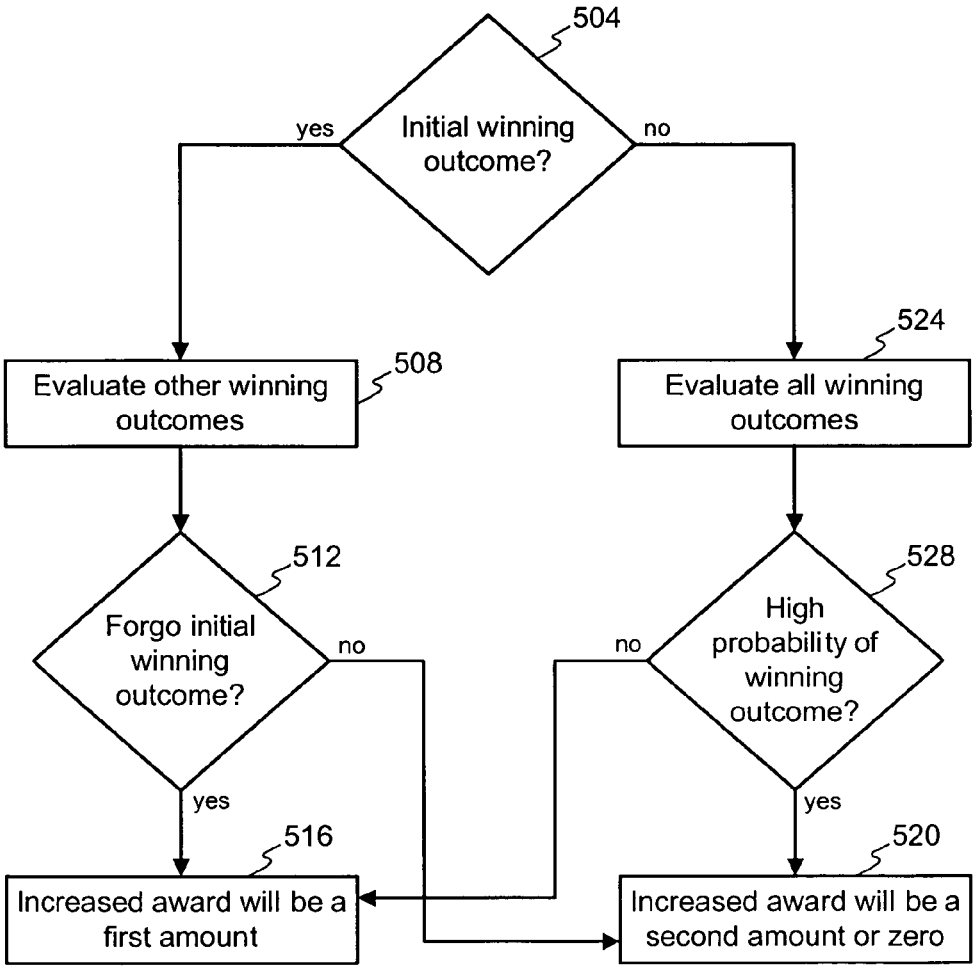
FIG. 5 is a flow diagram illustrating increasing the awards for particular outcomes according to an embodiment of the invention.

FIG. 5 is a flow diagram illustrating how the determination of step 312 may be made according to one embodiment. At a step 504, the initial set of indicia is evaluated to determine if the initial set of indicia defines one or more winning outcomes of the game. If the initial set of indicia is a winning outcome, at a step 508, the other winning outcomes of the wagering game may be evaluated to determine the amount awards for one or more of these winning outcomes will be increased.

In the embodiment shown, an increase in an award for winning outcomes that would require the player to give up his or her current winning outcome may be a first amount. To illustrate, at a step 512, if to achieve a particular winning outcome, the player must forgo his or her current winning outcome, the increase to the award for the particular winning outcome may a first amount at a step 516. In the case of a draw poker game for example, a player who received a Pair Jacks or Better upon the initial deal of cards would have to give up (i.e. forgo) the Pair of Jacks or Better hand as part of the discard/replacement round of the game, in order to try and achieve a Straight. Thus, the award for a Straight may be increased by a first amount relative to its current value (or the current paytable) because the player would have to give up the Pair of Jacks or Better to achieve a Straight.

An increase of the awards for winning outcomes that do not require the player to give up a current winning outcome may be a second amount. To illustrate, at the step 512, if to achieve a particular winning outcome, the player does not have to forgo a current winning outcome, the increase to the award for the particular outcome may be determined to be a second amount at a step 520. In the case of a poker game for example, a player having a Pair of Jacks or Better would not have to give up (i.e. forgo) the Pair of Jacks or Better to achieve a Full House. However, the player would have to forgo the Pair of Jacks or Better to achieve a Straight. Thus, the increase to the award for Full House may be a second amount.

Typically, but not always, the first amount will be larger than the second amount. This may be necessary in order to entice the player to forgo an already winning set of indicia in return for the opportunity to win larger awards. The second amount will typically be small or slight because the player does not have to forgo an already winning set of indicia. The smaller second amount still provides excitement and enticement for a player to play the game however. As described below, it is contemplated that the second amount may be zero in one or more embodiments. This is beneficial to the gaming establishment which may not desire to increase awards if the player does not have to forgo a winning set of indicia, among other reasons. As will be described further below, the increases to awards may be presented to a player via an updated or new paytable.

If, at the step 504, the initial set of indicia is not a winning outcome, the winning outcomes of the wagering game may still be evaluated at a step 524 to determine the amount awards for one or more of the winning outcomes will be increased. At the step 524, the initial set of indicia may be evaluated to determine the likelihood of achieving a winning outcome from the indicia present in the initial set. This may occur by calculating the odds of achieving each winning outcome based on the present indicia. Such calculation may take into account various aspects of the game being played. For example, the calculation may take into account the indicia present in the initial set of indicia, the number of indicia dealt, the indicia not dealt, the wager amount, or a combination thereof.

At a step 528, it may be determined if a particular winning outcome of the game has a high probability of occurring (e.g. is likely to occur). If so, the increase to the award for the particular winning outcome may be determined to be a second amount at step 520, such as described above. At the step 528, if a particular winning outcome of the game does not have a high probability of occurring (i.e. is not likely to occur), the increase to the award for the particular winning outcome may be determined to be a first amount at step 516, such as described above. As with the above, the first amount will typically be larger than the second amount. In addition, the second amount may be small or zero here as well.

Whether or not a particular winning outcome is likely to occur from an initial set of indicia may be defined in various ways. For example, if the odds of a particular winning outcome occurring from the initial indicia are above 50% or another predetermined threshold, the outcome may be deemed likely to occur in some embodiments. Of course, in other embodiments, a lower or higher threshold may be used. In one embodiment, the likelihood of each winning outcome occurring may be compared to determine the percentage required to deem a winning outcome likely to occur. For example, the odds of each winning outcome occurring may be averaged with any outcome having above average odds being deemed likely to occur. It is noted that other ways of deeming an outcome likely to occur may be used as well.

Once the determination has been made regarding which outcomes are to have their awards increased and by how much, the awards may be accordingly increased at a step 316. In a gaming machine for example, the awards may be increased by increasing award amounts in a memory device of the gaming machine. In this and other embodiments, the increases may be presented to a player via a paytable. The paytable may be presented on a display in one or more embodiments.

It is contemplated that an indication of the increases may be provided. For example, the increased awards may have a different color, font, text size, or the like as compared to awards that have not been increased. The increased awards may also be animated, flash, change color, or the like. In one embodiment for example, an animation where the award is incremented from its current amount to the increased amount may be presented. In this manner, a player may easily determine which awards have been increased. It is contemplated, that the paytable may also present the odds of achieving the outcomes having increased awards (or all winning outcomes) if desired. This allows the player to evaluate his or her chances in obtaining an increased award.

Figure 6A:
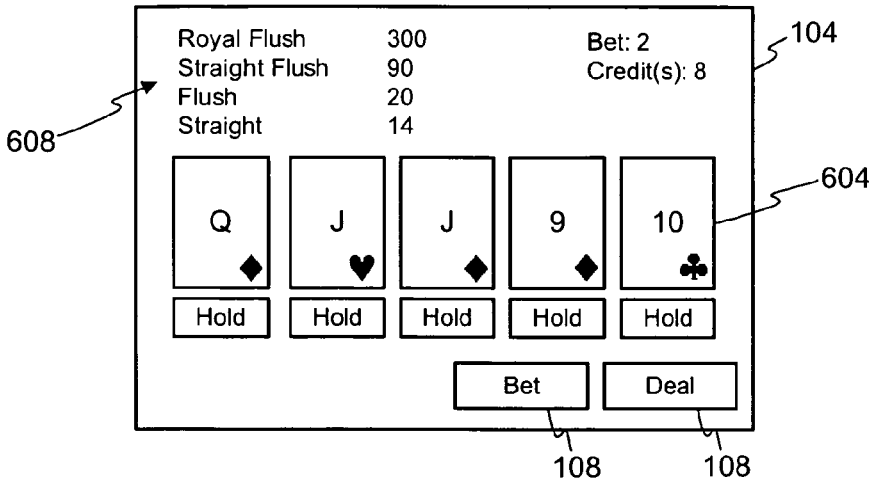
FIGS. 6A-6C illustrate exemplary paytables for various initial sets of indicia.
Figure 6B:
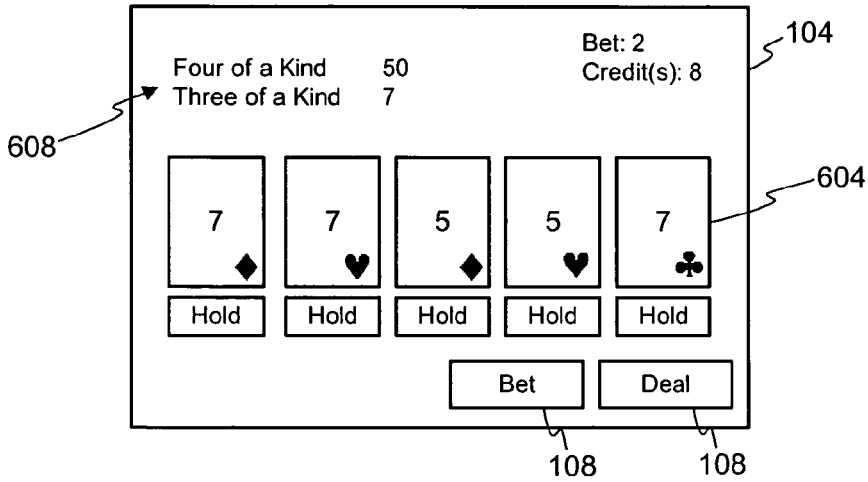
Figure 6C:
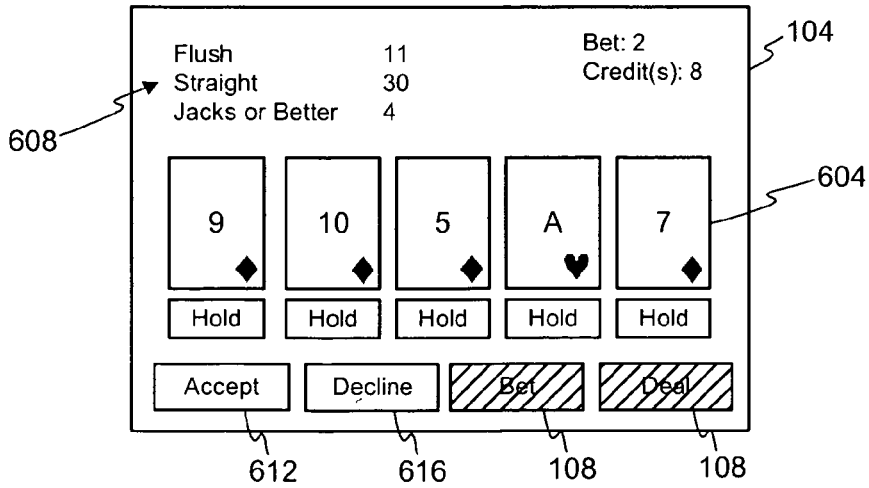

FIGS. 6A-6C illustrate various exemplary paytables for initial hands a player may receive in a poker type game. In this exemplary game, a player must obtain a Pair of Jacks or Better or a higher hand to win an award. In general, FIGS. 6A-6C show various increased awards for winning outcomes. The paytable of FIG. 4 is used as the base or original paytable for the wagering games in the following descriptions. It is noted that these paytables are for a particular wager. In one or more embodiments, the paytables may provide winning amounts for wagers of various sizes. As is known for example, a paytable may provide different winning amounts depending on the coins-in or credits/currency wagered.

In FIG. 6A, the initial set of indicia 604 contains a winning outcome of a Pair of Jacks or Better. As can be seen, the gaming machine has increased the awards for some winning outcomes based on the initial hand. This is shown by the paytable 608 presented on the left side of the display 104. As compared to the original paytable of FIG. 4, a Straight now pays 14 credits, a Flush 20 credits, a Straight Flush 100 credits, and a Royal Flush 300 credits. The player must forgo his or her current winning outcome of a Pair of Jacks or Better to obtain any of these increased awards. In return, the gaming machine provides the player a chance for the increased awards. It is noted that only the winning outcomes with increased awards are presented by the paytable 608 in this embodiment. In other embodiments, all winning outcomes may be presented.

In this manner, the opportunity enhances game play. In a traditional poker game a player would likely hold the winning Pair of Jacks or Better in his or her hand, knowing that this represents a guaranteed win (as compared, for example, to discarding those cards and risking that they do not obtain any winning hand). However, in accordance with the invention, the player may decide the award amount for a Pair of Jacks or Better is less than the opportunity to win one of the increased awards. This is especially so given that the award for a Pair of Jacks or Better is relatively insubstantial and that the other awards have been increased a relatively large amount.

The initial hand of FIG. 6A is such that a Straight or a Flush could be achieved with relatively good odds. A Straight Flush or a Royal Flush is also possible with the initial hand. It can be seen that the amount of increase for the Straight Flush and the Royal Flush have been greatly increased by a multiplier of three. Thus, though less likely of occurring, the player may decide to take the opportunity for these increased awards by attempting to obtain a Straight Flush or a Royal Flush. The player may similarly decide that the opportunity for the less increased awards for a Straight or a Flush is worth taking.

It can also be seen from the example of 6A, that the awards for winning outcomes which would not require the player to forgo his or her current winning hand have not been increased. For instance, the awards for Three of a Kind, Four of a Kind, and Full House have not been increased because achieving these outcomes would not require the player to forgo his or her current pair of Jacks. Of course, as stated above, awards for winning outcomes that do not require a player to forgo a current winning hand may be increased as well if desired. Typically, these increases, if any, will be slight or smaller than increases to awards for winning outcomes that do require a player to forgo his or her current winning hand.

In the example of FIG. 6B, the player's initial set of indicia 604 contains a Full House. This would pay the player 11 credits (based on the paytable in FIG. 4). As can be seen in the paytable 608 of FIG. 6B, however, if the player were to forgo the Full House and achieve a Four of a Kind, the player would be awarded an increased award of 50 credits. This is a larger award than a Straight Flush on the game's original paytable in FIG. 4. As can be seen, the player must forgo the current winning outcome of a Full House, which pays 11 credits, for the opportunity to win the increased award of 50 credits. It is noted in this example that the award for Three of a Kind has been increased to 7. In the event the player tries for four 7s but fails, the player would win the increased award for Three of a Kind. This provides additional enticement for the player to try for Four of a Kind and enhances the excitement of the wagering game.

It is noted that lesser ranked winning outcomes, such as the Three of Kind described above, may be achieved with a high probability by forgoing a current winning outcome in some cases. For example, a player having a Full House would be able to achieve Two Pair with high probability simply by discarding a single card. Likewise, the hand of a Pair of Jacks or Better could be achieved with a high probability where the initial indicia contain three or more Jacks or higher cards. Thus, in some embodiments, the awards for lesser ranking winning outcomes than the current winning outcome may not be increased even though the player would have to forgo a current winning outcome to achieve these lesser ranking outcomes.

In the example of FIG. 6C, the player's initial set of indicia 604 does not contain a winning outcome, however, the initial hand is such that one or more winning outcomes has relatively good odds of being achieved. For instance, the player has relatively good odds at achieving Jacks or Better or a Flush. There are likely worse odds at the player achieving a Straight, but a Straight is possible with the initial hand. Accordingly, the awards for Jacks or Better and a Flush have be increased a smaller amount than the award for a Straight. With regard to a Flush, it is noted that the suit of the initial set of indicia has been taken into account in determining the increased awards. Thus it can be seen that various characteristics of indicia may be used to determine when and how much to increase an award. Like the above, the increased awards are shown in the paytable 608 of FIG. 6C.

In one or more embodiments, the player may accept or decline the opportunity for increased awards. As stated above, one or more player input devices may allow the player to accept or decline the opportunity. For example, a player may engage an "accept" button to accept the opportunity. Likewise, in one embodiment, a "decline" button may be provided to decline the opportunity. FIG. 6C shows an embodiment having an accept button 612 and a decline button 616. As can be seen, other player input devices 108 have been disabled until the player chooses whether to accept or decline the opportunity for increased awards as shown by the paytable 608. This prevents the game from continuing until it is clear whether or not the opportunity has been accepted or declined. It is contemplated that the player may be charged one or more credits for accepting the opportunity in some embodiments. Where this is the case, a notification of the same may be provided to the player, such as on the display 104 of a gaming machine.

In one or more embodiments, a player may also impliedly accept or decline an opportunity by his or her choices in playing the game. For example, if a player continues play of a game without forgoing a current winning initial set of indicia, then the player has declined the opportunity for increased awards. It is contemplated that the choice to accept or decline the opportunity may be given to a player after the paytable having the one or more increased awards is presented. In this manner, the player can see the increased awards before deciding whether or not to accept the opportunity. The choice to accept or decline the opportunity may be accompanied by a screen which asks the user to continue by either accepting or declining the opportunity. Of course, such screen need not be provided in all embodiments because the acceptance or declination may be impliedly determined. Such screen may be advantageous in situations where the initial set of indicia does not contain a winning outcome.

Referring back to FIG. 3, once the appropriate award amounts have been increased in step 316, at a step 320 the initial set of indicia may be manipulated to determine an outcome for the game. Manipulation of the indicia will generally occur according to the game being played and may include dealing, replacing, discarding indicia, or a combination thereof. In a video poker embodiment for example, the player may be dealt cards not held by the player. In other embodiments, additional indicia may be provided, indicia may be replaced, or the like may occur within this step. It is noted that nothing may occur in this step regarding the indicia if the player so chooses. For example, in a video poker embodiment, the player may hold all cards of the initial set.

At a step 324, it is determined whether the indicia the player has is a winning outcome. If not, the player loses his or her wager and may start a new game by placing a wager at step 304. If the player has a winning outcome, the player is paid the outcome's associated award at a step 328. The amount of the payout will be determined by the outcome's associated award including any increases to the award such as described above.

Figure 7:
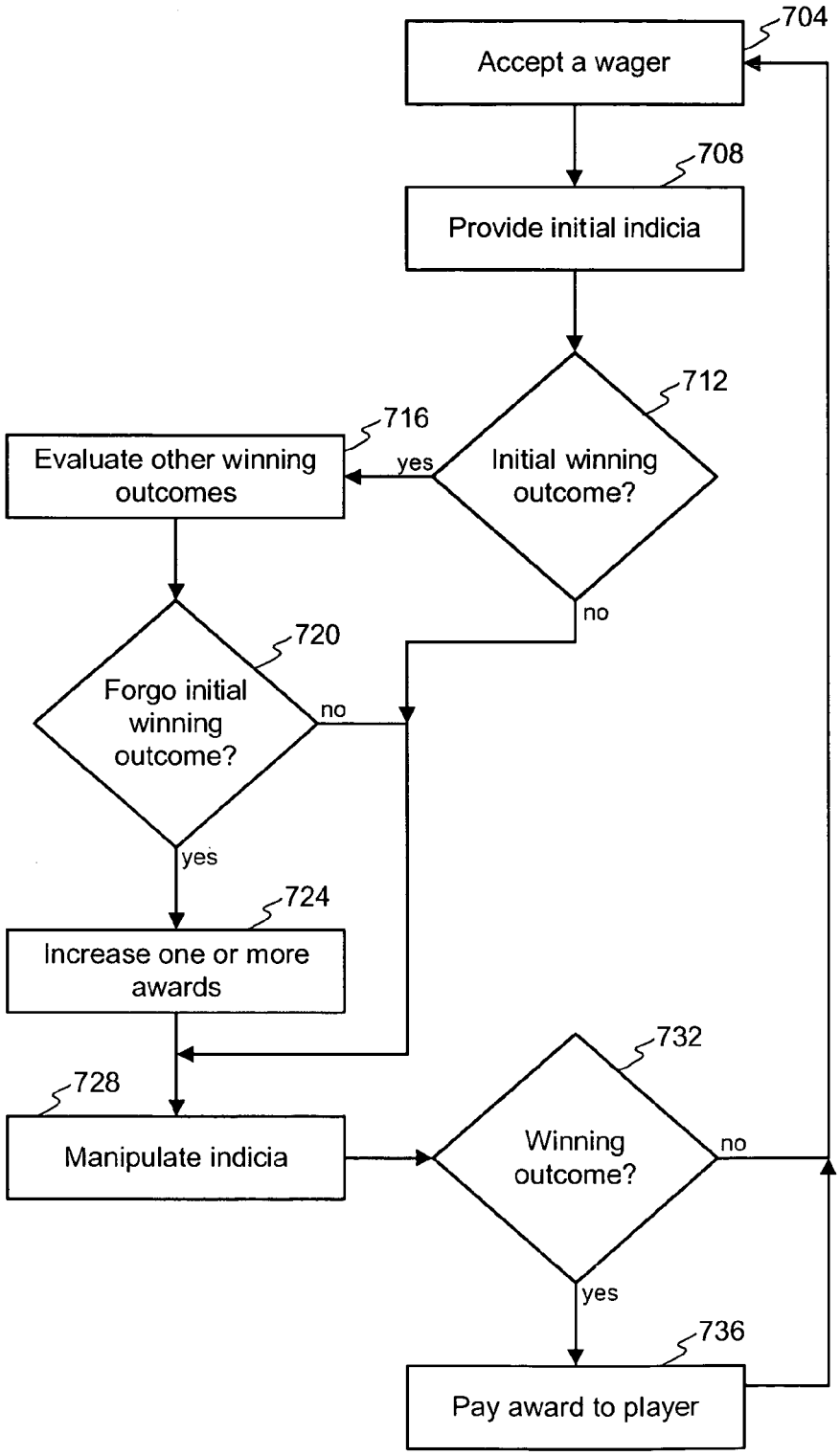
FIG. 7 is a flow diagram illustrating the opportunity for higher awards according to a preferred embodiment of the invention.

FIG. 7 is a flow chart illustrating a preferred embodiment of the game and opportunity for higher awards. In general, this embodiment presents the opportunity for higher awards only when an initial set of indicia contains a winning outcome. At a step 704, a wager may be accepted from a player. In response, an initial set of indicia may be provided at a step 708. These steps may occur as described above with regard to FIG. 3.

At a step 712, the initial set of indicia may be evaluated to determine if the initial set of indicia is a winning outcome. If the initial set of indicia is not a winning outcome the game may continue at a step 728. If the initial set of indicia is a winning outcome, the other winning outcomes of the game may be evaluated to determine increases to their associated awards, if any. This evaluation occurs at a step 716. If, to achieve a particular winning outcome, a player must forgo his or her current winning outcome, the award for the particular winning outcome may be increased at a step 724. If the player does not have to forgo the current winning outcome to achieve a particular winning outcome, the award for the particular outcome may not be increased. After each of the games winning outcomes have been evaluated and increased, where appropriate, the game may continue at the step 728. In one embodiment, a paytable or other notification may be updated or presented to the player to indicate which of the winning outcomes have been increased.

As discussed above, a player has to forgo a current winning outcome to achieve a different winning outcome when it is impossible to achieve the different winning outcome without giving up the current winning outcome. To illustrate, a player of a poker type game having an initial set of indicia which contains a Three of a Kind would not have to forgo the Three of a Kind to achieve a Four of a Kind or a Full House. Thus, in this embodiment, the award for these winning outcomes may not be increased. A player would however have to give up the Three of a Kind to achieve a Royal Flush, Straight Flush, Straight, or a Flush. Thus, awards for these winning outcomes may be increased in this embodiment. Depending on the indicia of the Three of a Kind, a player may give up the Three of a Kind to achieve Two Pair, Jacks or Better with a high probability. However, as discussed above, because Two Pair and Jacks or Better are lower ranked outcomes, the awards for these outcomes may not be increased.

The following chart illustrates which winning outcomes may be increased for initial sets of indicia containing particular winning outcomes according to one poker type embodiment. The leftmost column contains winning outcomes present in an initial set of indicia. A "yes" indicates which awards for which winning outcomes, as provided in the top row of the chart, are increased. As can be seen, only awards for winning outcomes which require a player to forgo an initial winning outcome are increased.

| | Jacks or Better | Two Pair | Three of a Kind | Straight | Flush | Full House | Four of a Kind | Straight Flush | Royal Flush |
|---|---|---|---|---|---|---|---|---|---|
| Jacks or Better | | | | yes | yes | | | yes | yes |
| Two Pair | | | | yes | yes | | yes | yes | yes |
| Three of a Kind | | | | yes | yes | | | yes | yes |
| Straight | | | | | yes | yes | yes | yes | yes |
| Flush | | | | | | yes | yes | yes | yes |
| Full House | | | | | | | yes | yes | yes |
| Four of a Kind | | | | | | | | yes | yes |
| Straight Flush | | | | | | | | | yes |
| Royal Flush | | | | | | | | | |

At the step 728, the indicia may be manipulated according to the rules of a wagering game as described above. One or more indicia may be dealt, replaced, discarded, or a combination thereof. An outcome will be generated from this step. At a step 732, if the outcome is a winning outcome, the player may be paid, at a step 736, the award associated with the winning outcome, including any increases to the award made in step 724. If the outcome is not a winning outcome, the player loses his or her wager, but may play a new game by placing a new wager at the step 704.

The manner or method of how the awards for certain outcomes are increased may vary. In one embodiment, such determinations are made via machine readable code or "software" which is executed by a processor or controller of the gaming machine. Of course, such instructions could also be embodied in the hardware of the machine, such as encoded in the processor or controller. In one embodiment, such a determination is made after the initial set of cards or other indicia are generated and dealt or displayed to a player. In one embodiment, various award amounts or winning outcomes might be randomly selected, such as from a potential set. For example, relative to the above-illustrated table, if a player is initially dealt a Pair of Jacks or Better, then one or more (or all) of the outcomes of a Straight, Flush, Straight Flush or Royal Flush might be selected. Further, the particular increased awards for those one or more outcomes might be randomly selected. For example, the increased awards might be selected from a range of values.

Preferably, as indicated, the gaming machine (such as via computer readable code or the like), performs an "analysis" of the initial set of indicia. This analysis preferably scrutinizes the initial indicia to create options for the player that cause the player to consider changing their play strategy, as compared to playing the game if the awards for all of the winning outcomes remain the same (as in standard poker). In this manner, the game is rendered much more exciting. As indicated, the method of the game forces a player to make new decisions about how to play the game, which options may enhance or increase the probability of losing an existing winning hand, and which may also result in opportunities for even higher awards.

As indicated, the invention has particular applicability to poker type games, and in particular to draw poker or similar games where a player receives an initial set of card and then has the opportunity to receive other or additional cards in an attempt to form a final hand. However, the invention has applicability to other games. For example, a player may receive an initial set of indicia in a slot-type game. Awards for one or more winning outcomes may then be enhanced and the player may be given the opportunity to spin one or more of the slot reels or otherwise replace one or more of the indicia in an attempt to achieve a winning outcome having an enhanced or increased award.

The award associated with a selected winning outcome may be changed in various ways. As indicated above, the award value associated with a particular winning outcome might simply be increased, such as from 10 to 20 credits. However, the award might be changed by associating a jackpot with a winning outcome. For example, the base or initial award for a particular winning outcome might be a fixed 20 credits. This outcome might be increased or changed to a jackpot value, such as 2503 credits. Further, the value of the jackpot may change over time, such as in the case of a progressive jackpot.

In one embodiment, the features of the game may be implemented as part of a wager placed to play a game. However, in other embodiments, a player may be required to place an additional wager, such as a side-bet, in order to activate the features of the invention. For example, a standard game of video poker may be implemented if a player places a wager of 1 credit. However, the game may be modified to include the features of the invention if the player places a wager of 2 credits or maximum credits or the like. Such additional wager amounts may be used to fund the increased awards. It is also possible for the game or aspects thereof to be implemented as a bonus game. For example, upon receiving a particular outcome or outcomes of a main game, a player might be presented with an opportunity to play the game of the invention. This opportunity may be presented without any additional requirement to that required to play the base game.

As indicated, while the game may preferably be presented at a gaming machine, the game may be presented in other manners. For example, the game may be implemented at a table using physical cards.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A method of presenting a game to a player of an electronic gaming machine in which the player has the opportunity for base or enhanced awards in that game, comprising the steps of:

accepting a wager from a player via a wager input device of said gaming machine;

providing a first pay table comprising a plurality of winning outcomes each having a base award associated therewith;

displaying an initial set of indicia to said player via an electronic video display of said gaming machine;

evaluating said initial set of indicia to determine if one or more indicia in said initial set of indicia is an initial winning outcome by comparing said initial set of indicia to said plurality of winning outcomes of said first pay table, said initial winning outcome being one of said plurality of winning outcomes;

wherein when said initial set of indicia is not an initial winning outcome defined by said first pay table, then:

continuing said game and determining an outcome of said game utilizing said first pay table;

and wherein when said initial set of indicia is an initial winning outcome, then:

designating at least one enhanced winning outcome comprising at least one of said winning outcomes which, in order to be achieved, requires said player to discard and replace at least one indicia that defines said initial winning outcome so that the remaining indicia from said initial set of indicia no longer defines said initial winning outcome, in an attempt to form said enhanced winning outcome; and continuing said game and determining an outcome of said game utilizing a second pay table having an enhanced award associated with said at least one enhanced winning outcome, said enhanced award being greater than said base award.

2. The method in accordance with claim 1 wherein said initial set of indicia comprises card indicia displayed on playing cards.

3. The method in accordance with claim 1 wherein a size of said enhanced award is dependent upon a probability that said enhanced winning outcome can be achieved from said initial set of indicia.

4. The method in accordance with claim 1 wherein said game comprises a game of draw poker in which said player is permitted to discard and replace none, one or more, or all of said initial set of indicia.

5. The method in accordance with claim 1 wherein said initial set of indicia comprises five cards.

6. The method in accordance with claim 1 wherein when said initial set of indicia is not an initial winning outcome, said step of continuing said game comprises discarding none, one or more or all of said indicia from said initial set of indicia, providing a replacement indicia for each discarded indicia to form a final set of indicia, and determining if said final set of indicia comprises a winning outcome from said first pay table and, if so, awarding said base award associated with said winning outcome.

7. The method in accordance with claim 6 wherein said second pay table defines a base award for each outcome which is defined as a winning outcome in said first pay table and an enhanced award for each enhanced winning outcome, and when said initial set of indicia is an initial winning outcome, said step of continuing said game comprises discarding none, one or more or all of said indicia from said initial set of indicia, providing a replacement indicia for each discarded indicia to form a final set of indicia, and determining if said final set of indicia comprises a winning outcome or an enhanced winning outcome from said second pay table and, if so, awarding said base award for a winning outcome or an enhanced award for an enhanced winning outcome.

8. A gaming machine comprising:

a controller;

at least one electronic display;

at least one player input device;

machine-readable code executable by said controller to cause said at least one electronic display to display an initial set of indicia to said player in response to a wager from said player;

machine-readable code executable by said controller to cause said controller to evaluate said initial set of indicia to determine if one or more indicia in said initial set of indicia is an initial winning outcome by comparing said initial set of indicia to a plurality of winning outcomes defined by a first pay table, said initial winning outcome being one of said plurality of winning outcomes;

machine-readable code executable by said controller to cause said controller to, when said initial set of indicia is not an initial winning outcome:

present said game utilizing a first pay table comprising a plurality of winning outcomes each having a base award associated therewith; and machine-readable code executable by said controller to cause said controller to, when said initial set of indicia is an initial winning outcome:

designate at least one enhanced winning outcome comprising at least one of said winning outcomes which, in order to be achieved, requires said player to discard and replace at least one indicia that defines said initial winning outcome so that the remaining indicia from said initial set of indicia no longer defines said initial winning outcome, in an attempt to form said enhanced winning outcome; and continue said game utilizing a second pay table having an enhanced award associated with said at least one enhanced winning outcome, said enhanced award being greater than said base award.

9. The gaming machine in accordance with claim 8 wherein said initial set of indicia comprises images of a hand of playing cards.

10. The gaming machine in accordance with claim 8 wherein said plurality of winning outcomes comprise poker hands.

11. The gaming machine in accordance with claim 8 wherein said machine-readable code is configured to cause said controller to cause said at least one electronic display to display a visual representation of said first pay table.

12. A method of presenting a game of draw poker to a player of an electronic gaming machine, comprising the steps of:

accepting a wager from a player via a wager input device of said electronic gaming machine;

providing a first pay table comprising a plurality of winning poker hands each having a base award associated therewith;

dealing an initial set of cards to said player and displaying said initial set of cards via an electronic video display of said electronic gaming machine;

evaluating said initial set of cards to determine if one or more cards in said initial set of cards is an initial winning poker hand by comparing said initial set of cards to said plurality of winning poker hands, said initial winning poker hand being at least one of said plurality of winning poker hands;

wherein when said initial set of cards is not an initial winning poker hand, then:

determining an outcome of said game utilizing said first pay table;

and wherein when said initial set of cards is an initial winning poker hand, then:

designating at least one enhanced winning poker hand comprising at least one of said winning poker hands which, in order to be achieved, requires said player to discard and replace at least one card that defines said initial winning outcome so that the remaining cards from said initial set of cards no longer defines said initial winning outcome, in an attempt to form said enhanced winning poker hand;

accepting input from said player via a player input device of said electronic gaming machine of at least one card which defines said initial winning outcome from said initial set of cards and replacing said at least one discarded card to form a final hand; and determining an outcome of said game based upon said final hand in comparison to a second pay table having an enhanced award associated with said at least one enhanced winning poker hand, said enhanced award being greater than said base award.

13. The method in accordance with claim 12, wherein if said initial set of cards is not an initial winning poker hard, then accepting input from said player of none, one or more or all of said initial set of cards to discard, replacing each discarded card to form a final hand, and wherein said step of determining an outcome of said game comprises comparing said final hand to said first pay table and if said final hand is a winning outcome, awarding said base award associated with said winning outcome.

14. The method in accordance with claim 12 wherein said second pay table defines a base award for each outcome which is defined as a winning outcome in said first pay table and which was not defined as an enhanced winning outcome, and an enhanced award for each enhanced winning outcome.

* * * * *